US009469096B2

(12) United States Patent
Reardon

(10) Patent No.: US 9,469,096 B2
(45) Date of Patent: Oct. 18, 2016

(54) TABLOID PRINTING PRESS AND RETROFITTING METHOD

(75) Inventor: Thomas John Reardon, Marietta, GA (US)

(73) Assignee: Goss International Americas, Inc., Durham, NH (US)

( * ) Notice: Subject to any disclaimer, the term of this patent is extended or adjusted under 35 U.S.C. 154(b) by 156 days.

(21) Appl. No.: 13/176,394

(22) Filed: Jul. 5, 2011

(65) Prior Publication Data

US 2011/0259224 A1 Oct. 27, 2011

Related U.S. Application Data

(62) Division of application No. 11/726,799, filed on Mar. 23, 2007, now abandoned.

(60) Provisional application No. 60/785,392, filed on Mar. 23, 2006.

(51) Int. Cl.

| | |
|---|---|
| ***B41F 33/00*** | (2006.01) |
| ***B41F 13/02*** | (2006.01) |
| ***B41F 13/10*** | (2006.01) |
| ***B41F 13/56*** | (2006.01) |
| ***B41F 13/08*** | (2006.01) |
| ***B41F 13/12*** | (2006.01) |
| ***B41F 7/04*** | (2006.01) |

(Continued)

(52) U.S. Cl.

CPC ..... *B41F 13/56* (2013.01); *B41F 7/04* (2013.01); *B41F 7/12* (2013.01); *B41F 13/08* (2013.01); *B41F 13/10* (2013.01); *B41F 13/12* (2013.01); *B41F 13/58* (2013.01)

(58) Field of Classification Search

CPC ..... B41F 7/04; B41F 7/12; B41F 13/10; B41F 13/56; B41F 13/58; B41F 13/02; B41F 13/08; B41F 13/0009; B41F 13/60; B65H 45/162; B41P 2227/11; B41P 2227/12

USPC ..... 101/227–228, 480; 270/5.01, 5.02, 21.1

See application file for complete search history.

(56) References Cited

U.S. PATENT DOCUMENTS 2,821,134 A * 1/1958 Brodie ..... 101/217
3,610,147 A * 10/1971 Crissy et al. ..... 101/228

(Continued)

FOREIGN PATENT DOCUMENTS

DE 198 038 09 8/1999
DE 19803809 A1 8/1999 ..... B41F 7/02

(Continued)

OTHER PUBLICATIONS

W. Walenski: "Der Rollenoffsetdruck", Fachschriftenverlag 1995, pp. 80-83, 190, see English translation (6 pages).

(Continued)

*Primary Examiner* — Jennifer Simmons
*Assistant Examiner* — Marissa Ferguson Samreth
(74) *Attorney, Agent, or Firm* — Davidson, Davidson & Kappel, LLC

(57) ABSTRACT

A 3 by 2 tabloid printing press includes a plate cylinder having a straight across lock-up and a blanket cylinder contacting the plate cylinder; a blanket cylinder printing a web; and a folder superstructure having at least one slitter for slitting the web into three ribbons and a folder for forming a tabloid newspaper from the three ribbons.

8 Claims, 4 Drawing Sheets

(51) Int. Cl.
*B41F 7/12* (2006.01)
*B41F 13/58* (2006.01)

(56) References Cited

U.S. PATENT DOCUMENTS

| | | | | |
|---|---|---|---|---|
| 4,538,517 | A | 9/1985 | Michalik et al. | 101/227 |
| 4,913,048 | A | 4/1990 | Tittgemeyer | 101/141 |
| 5,328,437 | A | 7/1994 | Maylander et al. | 493/357 |
| 5,921,183 | A | 7/1999 | Jones | 101/483 |
| 6,408,747 | B2 | 6/2002 | Koppelkamm et al. | 101/147 |
| 6,748,857 | B2 * | 6/2004 | Seiler | B65H 23/1882 101/220 |
| 6,971,311 | B2 | 12/2005 | Charette et al. | 101/415.1 |
| 7,296,516 | B2 | 11/2007 | Herbert et al. | 101/227 |
| 7,364,148 | B2 | 4/2008 | Herbert et al. | 270/5.2 |
| 7,523,925 | B2 | 4/2009 | Herbert et al. | 270/5.02 |
| 8,069,787 | B2 * | 12/2011 | Koblinger | B41F 27/12 101/378 |
| 2002/0189470 | A1 * | 12/2002 | Holm | 101/375 |
| 2004/0079247 | A1 * | 4/2004 | Dylla | 101/217 |
| 2004/0244615 | A1 | 12/2004 | Herbert et al. | 101/227 |
| 2004/0250717 | A1 | 12/2004 | Masuch et al. | 101/179 |
| 2006/0150838 | A1 * | 7/2006 | Hollings et al. | 101/180 |
| 2007/0161486 | A1 * | 7/2007 | Richards | 493/419 |
| 2008/0028965 | A1 * | 2/2008 | Herbert et al. | 101/453 |

FOREIGN PATENT DOCUMENTS

| | | | | |
|---|---|---|---|---|
| DE | 103 11 636 | | 11/2004 | |
| DE | 10311636 | A1 | 11/2004 | B41F 13/58 |
| GB | 1354924 | | 8/1970 | |
| JP | 62-135365 | | 6/1987 | |
| JP | 6-135622 | | 5/1994 | |
| JP | 2005-254821 | | 9/2005 | |
| JP | 2005-319815 | | 11/2005 | |
| WO | WO 03/031180 | | 4/2003 | |
| WO | WO 2005/005149 | | 1/2005 | |
| WO | WO 2005/091867 | | 10/2005 | |
| WO | WO 2006/108779 | | 10/2006 | |
| WO | WO 2006108779 | A2 | 10/2006 | B41F 13/58 |

OTHER PUBLICATIONS

W. Walenski, Der Rollenoffsetdruck, Fachschriftenverlag 1995, p. 80-82, 190, 216, 217.
H. Teschner, Offsetdrucktechnik, p. 10/67-10/68, 9. Auflage 1995.
Grounds for the Decision of the Opposition before the EPO.

* cited by examiner

TABLOID PRINTING PRESS AND RETROFITTING METHOD

This is a divisional application of U.S. application Ser. No. 11/726,799 filed Mar. 23, 2007, which claims the benefit of U.S. Provisional Application No. 60/785,392 filed Mar. 23, 2006, Both applications are incorporated by reference herein.

BACKGROUND

The present invention relates generally to printing presses.

A 4 by 2 printing press, for example, provides for four printing plates across a plate cylinder and two printing plates around the circumference of the plate cylinder. Thus a total of eight images may be printed onto a web from one plate cylinder. The Uniliner double-wide press from Goss International for example may have such plate cylinders.

Such double-wide plate cylinders typically are at least forty six inches wide and may be for example forty inches in circumference or more. A plate cylinder for example may have fifty six inches in width and forty four inches in circumference.

These double-wide plate cylinders often have staggered plate lock-ups for the tail and lead edges of the printing plates, as shown in FIGS. 1 and 3 for plate cylinder 10. Since plate cylinder 10 fits two printing plates around the circumference of plate cylinder 10, for example printing plates 12 and 14, lock-ups at one axial location are 180 degrees apart, located at the lead and tail end of each printing plate 12, 14. A typical four wide plate cylinder will have a lock-up for two of the plates staggered 90 degrees with respect to a lock-up for two other plates spaced axially. This staggering improves balance in the cylinder and reduces vibration during printing. As shown in FIG. 3, a lock-up 30 for printing plates 12 and 14 on plate cylinder 10 is staggered 90° with respect to a lock-up 32 for printing plates 16, 18.

The four wide plate cylinder often is used to produce a regular tabloid or Broadsheet. A Berliner tabloid is a newspaper format with pages normally measuring about 470 mm×315 mm (18.5 in×12.4 in).

SUMMARY OF THE PRESENT INVENTION

The present invention provides a 3 by 2 tabloid printing press comprising a plate cylinder having a straight across lock-up and a blanket cylinder contacting the plate cylinder, the blanket cylinder printing a web; and a folder superstructure having at least one slitter for slitting the web into three ribbons and a folder for forming a tabloid newspaper from the three ribbons.

The at least one slitter may include a longitudinal slitter to slit the web into a ⅓ ribbon and a ⅔ ribbon, and/or a tab slitter for the ⅔ web.

The folder superstructure may include a stitcher to stitch the ribbons together, and also may include a compensator and angle bars for the ribbons.

The present invention also provides a method for retrofitting a double wide 4 by 2 printing press to form a 3 by 2 tabloid printing press comprising the steps of: removing a 4 by 2 plate cylinder and replacing it with a 3×2 plate cylinder.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
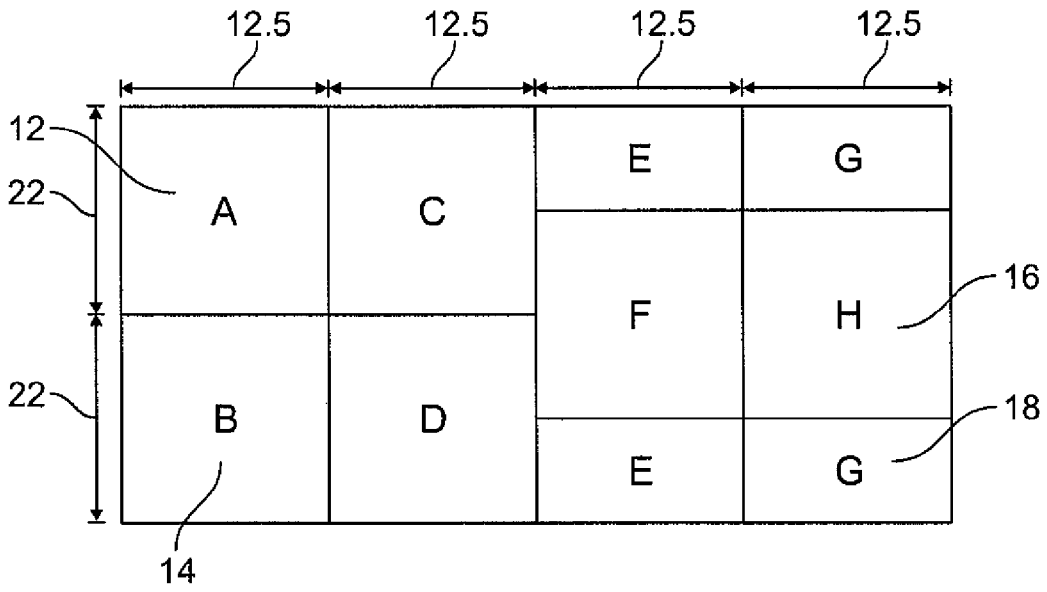
FIG. 1 (Prior Art)
FIGS. 1 and 3 show a prior art plate cylinder and corresponding printing plate layout.
Figure 3:
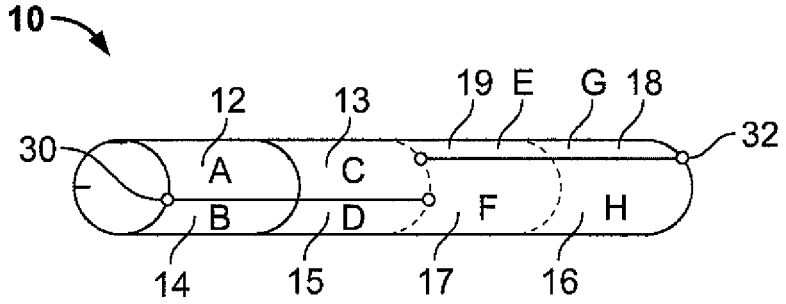
FIG. 3 (Prior Art)

FIGS. 1 and 3 show prior art printing plate cylinder 10 and a prior art layout for printing plates 12, 13, 14, 15, 16, 17, 18, 19. The printing plates 12, 13, 14, 15, 16, 17, 18, 19 are for example, 12.5 inches wide and 22 inches long. In the prior art, printing plates 12, 14 are staggered 90° with respect to printing plates 16, 18 on plate cylinder 10, so images A, B, on printing plates 12, 14 are staggered 90° with respect to images G, H on printing plates 16, 18 respectively. As shown in FIG. 3, plate lock-ups 30 and 32 also are staggered 90° with respect to each other.

Figure 2:
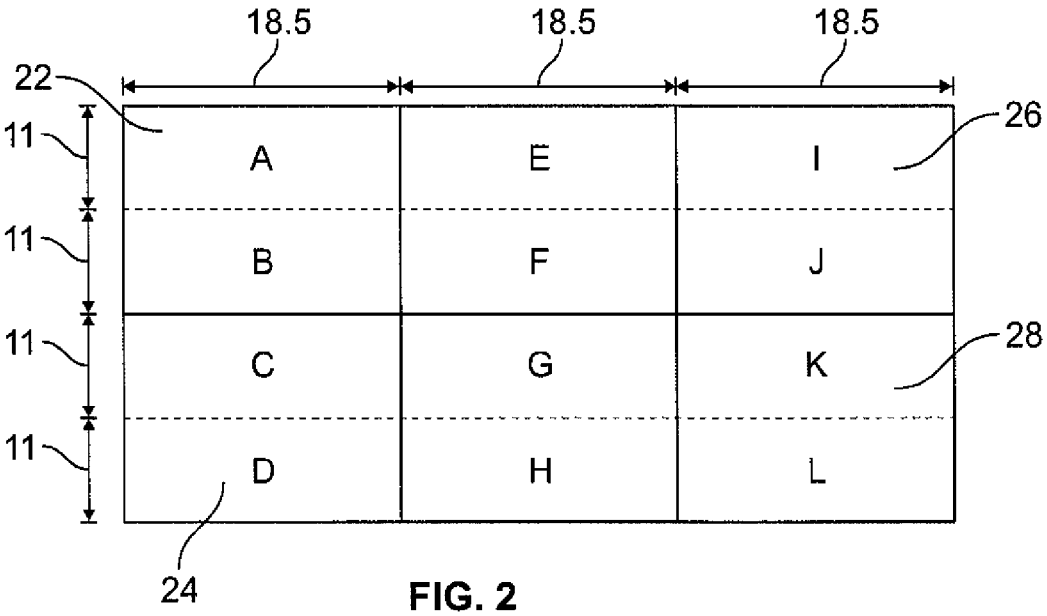
FIG. 2 shows a printing plate layout according to one embodiment of the present invention.
Figure 4:
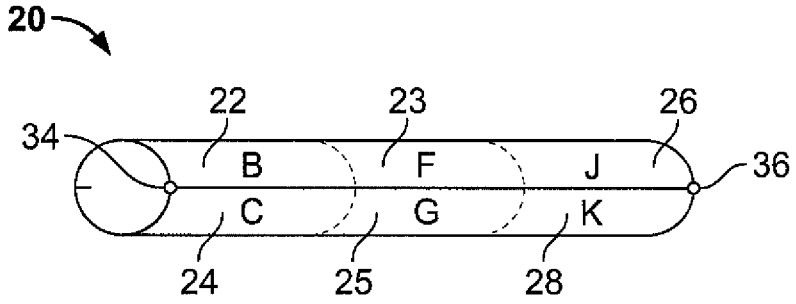
FIG. 4 shows a printing plate cylinder having the printing plate layout shown in FIG. 2.

FIGS. 2 and 4 show a layout for printing plates 22, 23, 24, 25, 26, 28 and a plate cylinder 20 according to an embodiment of the present invention. The printing plates 22, 23, 24, 25, 26, 28 are, for example, 18.5 inches wide and 22 inches long. The plate lock-ups 34, 36 are aligned straight across plate cylinder 20 so the printing plates 22, 23, 24, 25, 26, 28 are not staggered across plate cylinder 20. As shown in FIGS. 2 and 4, images for a tabloid product A, B, C, D, E, F, O, H, I, I, K, L are laid out on printing plates 22, 23, 24, 25, 26, 28, two images being on each plate. For example, images A and B are on printing plate 22.

Figure 5:
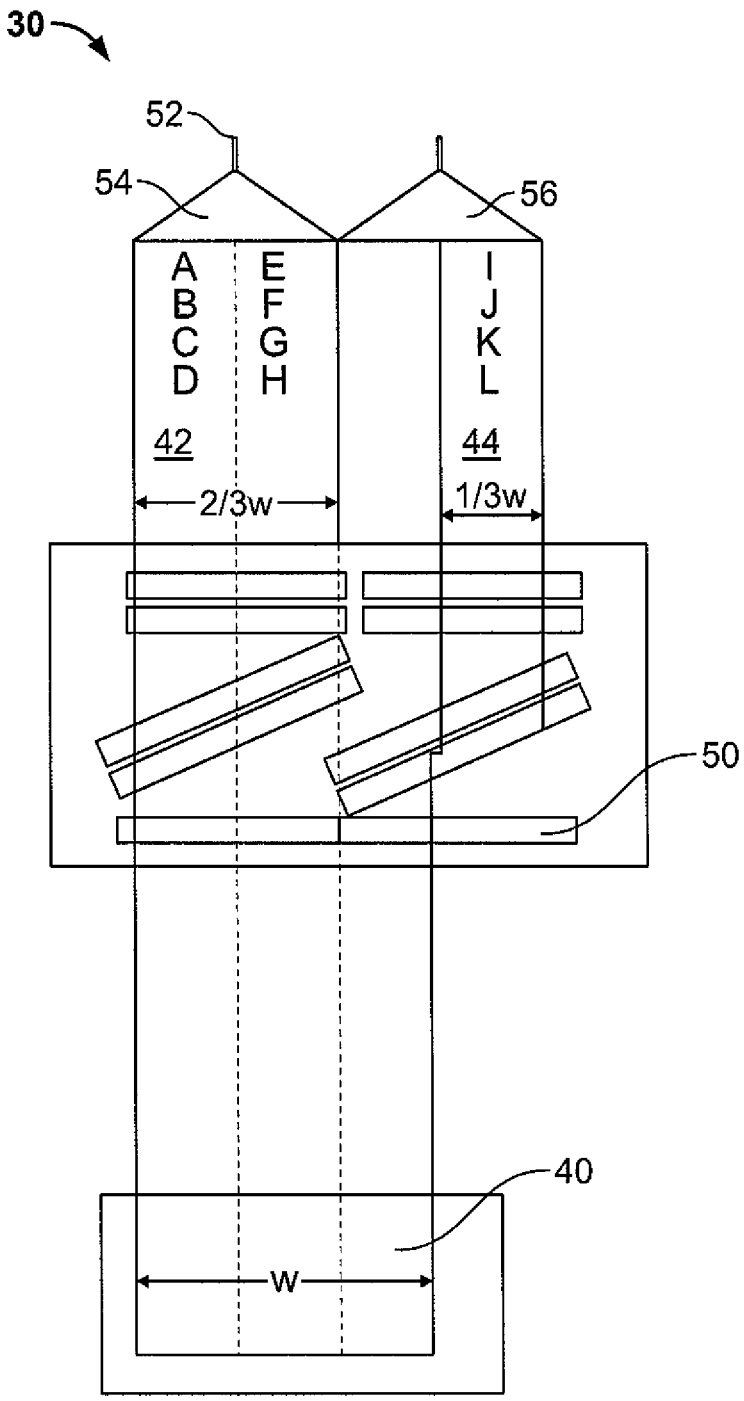
FIG. 5 shows part of the folder superstructure for a printing press according to the present invention.

FIG. 5 shows part of a folder superstructure 30 for one embodiment of a printing press of the present invention, a printed web 40 having a width ω being slit into two ribbons 42, 44 by a first longitudinal slitter 50. Ribbon 42 has a width two-thirds the width ω of web 40 and ribbon 44 has a width one-third the width ω of ribbon 40. Further downstream, ribbon 42 is slit further into two ribbons each having a width of ⅓ω by a tab slitter 52 of a former 54. A second former 56 can be provided so web 40 could also be slit ⅓, ⅔ with the ⅔ω ribbon passing over former 56 and slit by an associated tab slitter.

Figure 6:
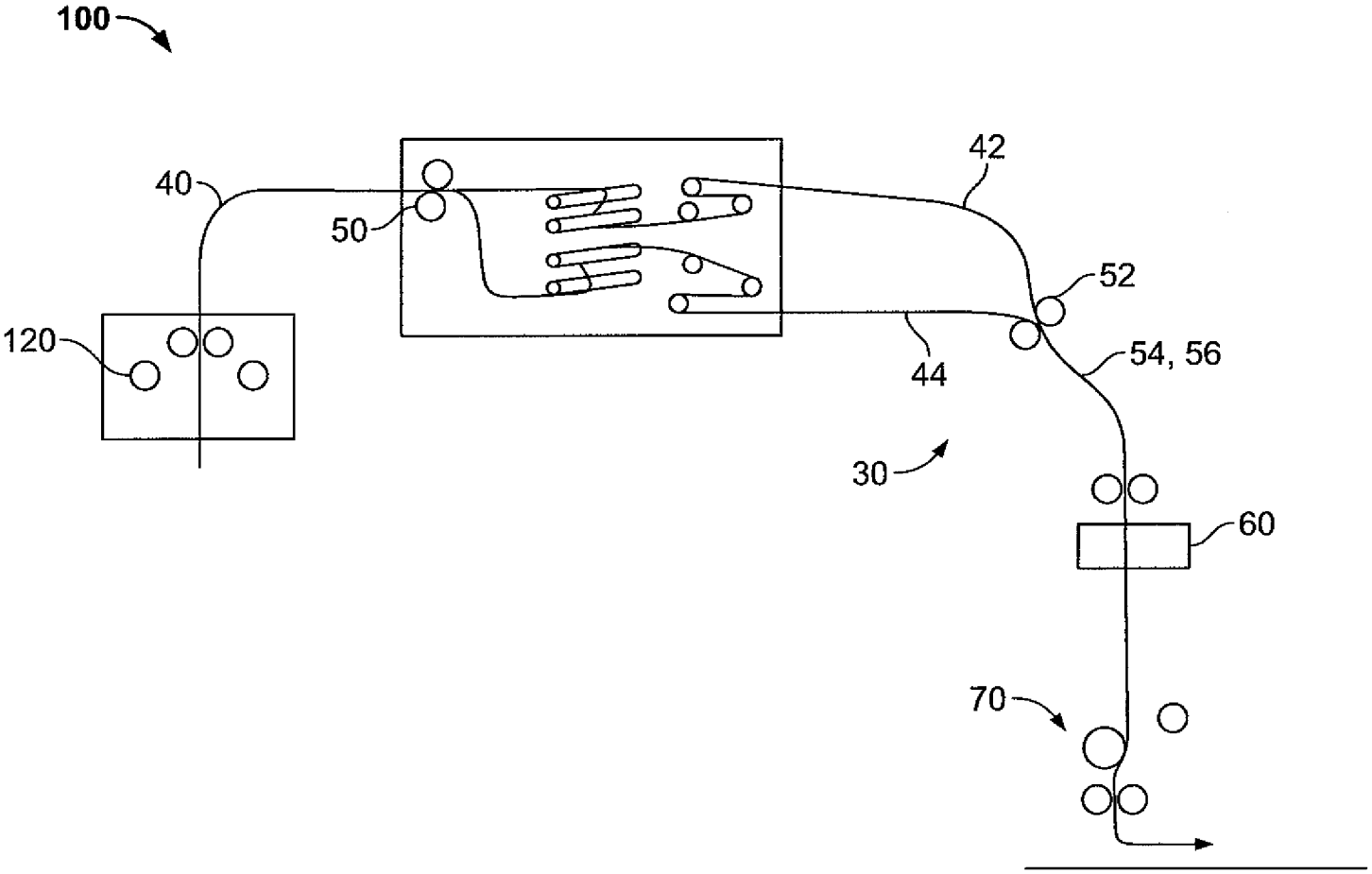
FIG. 6 shows a printing press according to the present invention.

FIG. 6 shows a printing press 100 with printing unit 120 printing on web 40. After formers 54, 56, each of the ⅓ω ribbons are combined and pass to a stitcher 60. Stitcher 60 holds the tabloid product together by placing a stitch in the spine prior to folding and cross cutting in a folder 70. Thus, printing press 100 can create a Berliner format tabloid.

Retrofitting of an existing 4×2 printing press can occur by replacing the plate cylinder with the plate cylinder 20 of the present invention, and providing a modified slitter section to provide for a ⅔, ⅓ slit. The former section may be modified to provide formers to handle 40 inch web widths so that the formers slit the ⅔ω ribbon, which can be for example 37 inches wide, further into two ⅓ω ribbons, each having a width of 18.5 inches.

Nip assemblies, folding cylinders and the delivery can be modified to accept a larger format. Section capability can be provided by providing a stitcher or staple device under each former.

What is claimed is:

1. A method for retrofitting a double wide 4 by 2 printing press to form a 3 by 2 tabloid printing press comprising the steps of:

retrofitting a double wide 4 by 2 printing unit of the 4 by 2 printing press to form a 3 by 2 tabloid printing unit by removing a 4 by 2 plate cylinder positioned to print a web and replacing the 4 by 2 plate cylinder with a 3 by 2 plate cylinder positioned to print the web.

2. The method as recited in claim 1 further comprising providing a modified slitter downstream of the 3 by 2 plate cylinder arranged to slit the web to into a ⅔ ribbon and a ⅓ ribbon.

3. The method as recited in claim 2 further comprising providing a tab slitter downstream of the modified slitter arranged to slit the ⅔ ribbon into two additional ⅓ ribbons.

4. The method as recited in claim 3 wherein the modified slitter and the tab slitter are arranged such that each ⅓ ribbon is 18.5 inches wide.

5. The method as recited in claim 1 wherein the 4 by 2 printing press is configured to create a regular tabloid or Broadsheet newspaper and is retrofitted into the 3 by 2 printing press configured to create a Berliner format tabloid newspaper.

6. The method of claim 1, wherein the 4 by 2 plate cylinder includes plate lock-ups that are staggered 90 degrees with respect to each other, and wherein the 3 by 2 plate cylinder includes plate lock-ups that are all aligned straight across the 3 by 2 plate cylinder and are not staggered.

7. A method of configuring and operating a printing press comprising:

retrofitting a double wide 4 by 2 printing unit of the 4 by 2 printing press to form a 3 by 2 tabloid printing unit by removing a 4 by 2 plate cylinder positioned to print a web and replacing the 4 by 2 plate cylinder with a 3 by 2 plate cylinder positioned to print the web;

providing a modified slitter section configured to slit the web into three ribbons;

printing the web with the 3 by 2 plate cylinder;

slitting the web into the three ribbons using the modified slitter section, each ribbon having a width equal to ⅓ of a width of the web; and folding and cross cutting the ribbons to create a Berliner format tabloid.

8. The method of claim 7, wherein the 4 by 2 plate cylinder includes plate lock-ups that are staggered 90 degrees with respect to each other, and wherein the 3 by 2 plate cylinder includes plate lock-ups that are all aligned straight across the 3 by 2 plate cylinder and are not staggered.

* * * * *